US009328496B2

(12) United States Patent
Perotto

(10) Patent No.: US 9,328,496 B2
(45) Date of Patent: May 3, 2016

(54) SYSTEM FOR THE ELIMINATION OF ODOURS FOR A FLUSHING SANITARY APPARATUS

(71) Applicant: Ezio Perotto, Roata Rossi (IT)

(72) Inventor: Ezio Perotto, Roata Rossi (IT)

( * ) Notice: Subject to any disclaimer, the term of this patent is extended or adjusted under 35 U.S.C. 154(b) by 0 days.

(21) Appl. No.: 14/411,014

(22) PCT Filed: Jun. 19, 2013

(86) PCT No.: PCT/IB2013/055034

§ 371 (c)(1),
(2) Date: Dec. 23, 2014

(87) PCT Pub. No.: WO2014/001971

PCT Pub. Date: Jan. 3, 2014

(65) Prior Publication Data

US 2015/0211222 A1 Jul. 30, 2015

(30) Foreign Application Priority Data

Jun. 25, 2012 (IT) ..... TO2012A0555

(51) Int. Cl.
*E03D 9/04* (2006.01)
*E03D 9/052* (2006.01)

(52) U.S. Cl.
CPC ..... *E03D 9/052* (2013.01)

(58) Field of Classification Search
CPC ..... E03D 9/052
USPC ..... 4/209 R–209 FF
See application file for complete search history.

(56) References Cited

U.S. PATENT DOCUMENTS 1,931,052 A 10/1933 Baither

FOREIGN PATENT DOCUMENTS

EP 2 224 067 9/2010
GB 2 327 905 2/1999

OTHER PUBLICATIONS

International Search Report for International Application No. PCT/IB2013/0555034mailed Dec. 12, 2013 (2 pages).

*Primary Examiner* — Lori Baker
(74) *Attorney, Agent, or Firm* — Merchant & Gould P.C.

(57) ABSTRACT

A system (10) includes a water and/or air inlet (20), connectable to a water supply pipe (5) for a sanitary apparatus (1). An outlet (40) connects to a sewage outlet pipe (4) downstream of the sanitary apparatus. The inlet leads from a suction box (30), which starts the outlet (40). A motorized ventilation device (31) conveys air from the inlet (20) to the outlet (40). A siphon (32) is at least partially filled with water (33) from the water supply device (6). The ventilation device (31) and the siphon (32) are mutually in series between the inlet (20) and the outlet (40). The suction box (30) includes a further siphon (321), connected between the supply pipe (5) and the outlet pipe (4) and is arranged in parallel with respect to the siphon (32) and the device (31). The further siphon (321) is at least partially filled with water.

5 Claims, 3 Drawing Sheets

SYSTEM FOR THE ELIMINATION OF ODOURS FOR A FLUSHING SANITARY APPARATUS

This application is a National Stage Application of PCT/IB2013/055034, filed 19 Jun. 2013, which claims benefit of Serial No. TO2012A000555, filed 25 Jun. 2012 in Italy and which applications are incorporated herein by reference. To the extent appropriate, a claim of priority is made to each of the above disclosed applications.

TECHNICAL FIELD

The present invention is relative to a system for the elimination of odours or smells for a flushing sanitary apparatus.

TECHNOLOGICAL BACKGROUND

It is widely known that one of the problem of bathrooms, both public and private, is to manage bad smells after the use of sanitary apparatus such as the toilet or the bidet. In particular, for those bathrooms that are provided with small-size openings, which may even be arranged in a high position and, therefore, are difficult to reach, the change of air becomes difficult, thus worsening the presence of a stagnant smell in the room itself.

Furthermore, there are bathrooms that have no windows or similar openings towards the outside (the so-called blind rooms), which typically require suction systems for stale air that operate by means of a fan.

These systems usually comprise a suction means, which typically is a tangential fan or a paddle wheel fan and is arranged on a structure that is at least partially recessed in the upper part of a wall or in the ceiling of the bathroom; the fan is activated by an electric motor, usually by means of a direct shaft transmission, so as to suck the air from the bathroom towards the outside.

The fan is connected to an air extraction duct, which is usually built-in in a wall of the building where the bathroom is located, so as to allow the air sucked to be carried towards a flue or towards the outside of the building.

These systems have the drawback to necessary require great masonry works during the creation of said air extraction ducts and are not efficient in terms of smell reduction in place.

In detail, indeed, these systems have the drawback to extract the air away with respect to the sanitary apparatus, namely far from the source of the smells itself and, especially in large and high rooms, once the smells have reached the system, they have already saturated most of the inner volume of the bathroom.

Furthermore, since the bathroom is a room that is not hermetically insulated from the others, part of the air sucked by the system is re-drawn, due to the modest pressure decrease in the room, for example by adjacent rooms and not directly by the sanitary apparatus. In order to improve the efficiency of these systems, one could use high-capacity or large-size fans, which, though, impose tight limits to the usability in terms of dimensions, noise produced (which is crucial, especially for buildings of civil use, during the night) and electrical input.

There are also direct smell sucking systems from the sanitary apparatus, such as the one described in patent no. GB 2 327 905 A, owned by Panfan International Limited, which discloses an apparatus for the removal of smells from rooms containing sanitary apparatus, which is provided with a fan that is connected to a water draining duct to drain water from the tank and is able to directly suck the smells from the sanitary apparatus, thus carrying the air sucked to the outside of the building.

Document GB 2 327 905 A, though, implies some drawbacks; firstly, as a matter of fact, the fan described in the document is inserted into the wall, which does not obviate the need for significant masonry works for the installation thereof and this is even more important if the apparatus has to be installed after the creation of the wall of the building. Secondly, furthermore, when the fan is disabled, there is a high risk that part of the smells flow again into the duct from the outside of the building (for example due to an air convection phenomenon—just think about the case in which the inner room is very hot and high and the outside of the building is cold: due to thermal convection, the air would tend to re-flow into the tube towards the sanitary apparatus). Finally, in order for the apparatus described in the document to effectively work, it is necessary for the apparatus itself to easily reach the outside of the building or an air outlet duct. Indeed, assuming to have blind rooms that do not communicate with any peripheral wall of the building, the path of the fan towards the outside would necessarily be long and winding. The loss of pressure inside the outlet duct would necessarily require the use of fan having a power that is much higher than the one that would be needed in case of a short duct, thus causing, in order to reach the same result, an increase in energy consumption and noise produced.

Finally, there are buildings with a particular historical or artistic value, in which, even if the bathroom communicates with a peripheral wall, nothing can be installed towards the outside of the building itself. Consequently, in this case, it would be necessary to have an outlet duct that is arranged on the outside or on the roof, with significant installation costs.

An effective solution for the drawbacks mentioned above is described in document EP 2 224 067 A1, owned by the Applicant.

More in detail, this document describes a device for eliminating smells for a flush type sanitary apparatus, wherein the sanitary apparatus is connected to a flush water supply device by means of a supply pipe. The device comprises a water and/or air inlet pipe, an outlet pipe and a suction box comprising a motorized ventilation means. The suction box is connected to the inlet pipe and to the outlet pipe, and the device has a siphon that is partially filled with water after the flushing of the sanitary apparatus. The siphon is connected to the ventilation means and the outlet pipe is connected to a sewerage system.

The device described in document EP 2 224 067 A1 allows users to easily eliminate smells by directly sucking the air inside the sanitary apparatus, thus avoiding or anyway minimizing their dispersion inside the bathroom.

Furthermore, for the entire duration of the use of the sanitary apparatus, possible bad smells are directly drawn and sucked from the place in which they are generated and follow a path that, starting from the sanitary apparatus, extends through the inlet pipe, the fan and the siphon in order to reach the outlet pipe. Hence, thanks to the presence of the siphon in the device, one can avoid the return of the bad smells already sucked or of bad smells coming from the sewerage system.

SUMMARY OF THE INVENTION

An object of the present invention is to provide an improved system for the elimination of smells for a flushing sanitary apparatus, which, at the same time, can be produced in a simple and economic fashion.

According to the present invention, this and other objects are reached by means of a system according to appended claim 1.

The appended claims are an integral part of the technical teaches provided in the following detailed description concerning the present invention.

BRIEF DESCRIPTION OF THE DRAWINGS

Further features and advantages of the present invention will be best understood upon perusal of the following detailed description, which is provided by way of example and is not limiting, with reference to the accompanying drawings, which specifically show what follows.

DETAILED DESCRIPTION OF THE INVENTION

Figure 1:
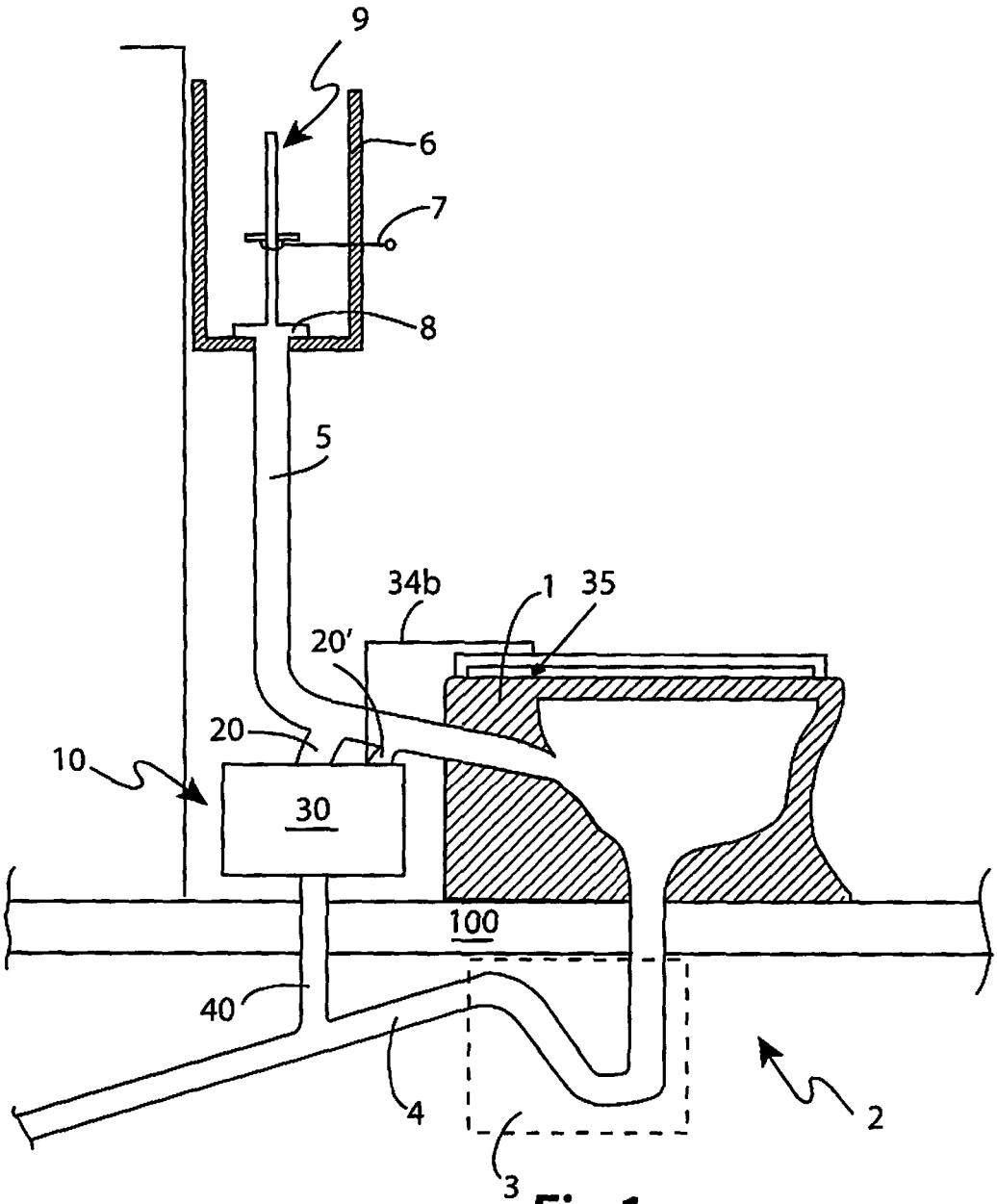
FIG. 1 shows a section view of a part of a bathroom with a sanitary apparatus and the system according to an explanatory embodiment of the present invention.

With reference to FIG. 1, number 1 indicates, as a whole, a system for the elimination of smells for flushing sanitary apparatus.

FIG. 1 shows an example of a sanitary apparatus 1, such as a toilet, which is fixed to a floor 100 of a building and has, at the outlet, a draining pipe union 2, which is advantageously provided with a siphon 3, downstream of which there is a sewage outlet pipe 4, which is connected to the sewerage system of the building. Furthermore, sanitary apparatus 1 is connected, at the inlet and by means of a water supply pipe 5, to a water supply device, for example a tank 6. In the embodiment shown, supply pipe 5 is connected, on one side, in correspondence to its upstream end, to sanitary apparatus 1 and, on the other side, in correspondence to its downstream end, to water supply device or tank 6, adapted to allow the sanitary apparatus to be flushed and is arranged at a higher height with respect to sanitary apparatus 1.

System 10 comprises: at least one water and/or air inlet pipe union 20, which can be connected to supply pipe 5; at least one outlet pipe union 40, which can be connected to sewage outlet pipe 4, advantageously downstream of draining pipe union 2; and a suction box 30, to which said inlet pipe union 20 leads and from which said outlet pipe union 40 starts.

Suction box 30 comprises, in turn: a motorized ventilation device 31, which is adapted to convey air from said inlet pipe union 20 to said outlet pipe union 40; and a siphon 32, adapted to be at least partially filled with water 33 coming from said water supply device, for example tank 6, through supply pipe 5 after said sanitary apparatus 1 has been flushed. Ventilation device 31 and siphon 32 are arranged in suction box 30 in series with respect to one another and are connected between inlet pipe union 20 and outlet pipe union 40.

Suction box 30 comprises, furthermore, a further siphon 32', which can be hydraulically connected between supply pipe 5 and sewage outlet pipe 4 and is arranged in parallel with respect to the assembly hydraulically formed in series by siphon 32 and by ventilation device 31. The further siphon 32' is adapted to be at least partially filled with further water 33', which tends to become stagnant in supply pipe 5 upstream of sanitary apparatus 1.

In this way, further siphon 32' can channel thorough itself a quantity of water that has possibly become stagnant in a downstream section of supply pipe 5 arranged close to sanitary apparatus 1. Therefore, the pipe path extending from sanitary apparatus 1 towards ventilation device 31 tends to be cleared from the presence of water, so as to allow bad smells to be correctly sucked by system 10 and, at the same time, so as to reduce the risk of an undesired bubbling or clogging during the operation.

Preferably, the further siphon 32' can be connected to supply pipe 5 downstream of inlet pipe union 20.

Preferably, suction box 30 comprises a further water and/or air inlet pipe union 20', which can be connected to supply pipe 5 and leads to the further siphon 32'.

Preferably, the further siphon 32' leads to outlet pipe union 40.

In further embodiments that are not shown, the suction box can comprise a further outlet pipe union, which can be connected to sewage outlet pipe 4 downstream of said draining pipe union 2. In this case, the further siphon 32' leads to said further outlet pipe union.

According to a further embodiment that is not shown, the suction box can simultaneously comprise the further inlet pipe union 20' and said further outlet pipe union, between which the further siphon 32' is arranged. Therefore, in this case, the structure of the suction box defines a first hydraulic branch comprising inlet pipe union 20, the assembly made up of ventilation device 31 and of siphon 32 that are hydraulically connected in series, and outlet pipe union 40, and a second hydraulic branch comprising the further inlet 20', the further siphon 32' and the further outlet pipe union. The first and the second branch, in this way, are separate and independent from one another from the hydraulic point of view.

Preferably, in case the above-mentioned water supply pipe 5 has a vertical portion under said tank 6 and an oblique portion for the connection to sanitary apparatus 1, inlet pipe union 20—and, if necessary, the further inlet pipe union 20'—is connected downstream of the vertical portion, so as not to be directly hit by the water flow falling down and, at the same time, so as to be closer to sanitary apparatus 1.

In the embodiment shown, tank 6, which is of the known type, is typically provided with a lever 7 or a similar mechanism for the activation of the water supply, which lifts a plug 8 arranged on the bottom of the tank itself by acting on a lifting cylinder 9.

Figure 2:
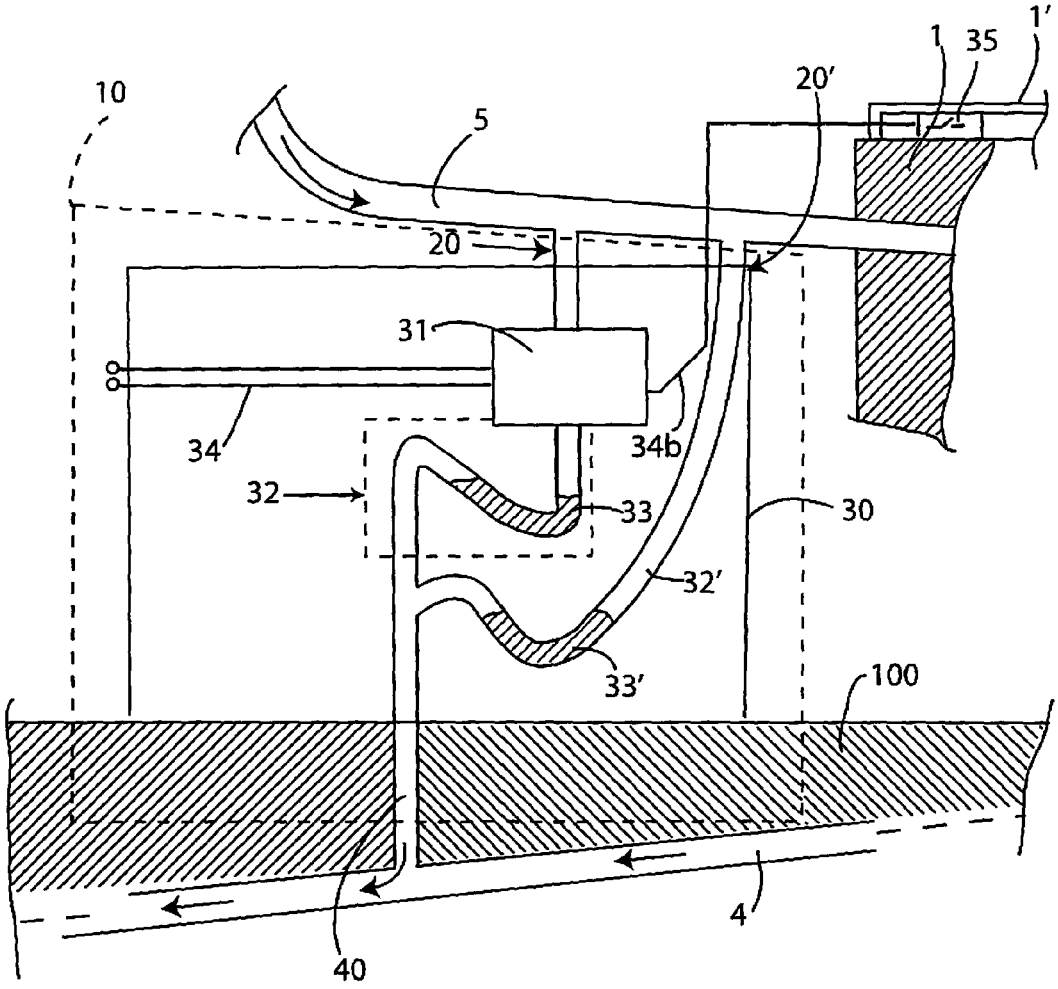
FIG. 2 shows an enlarged view of a part of FIG. 1 showing inner details of the system according to the present invention.

With reference, in particular, to FIG. 2, system 10 is shown, by way of example, in one of its most essential versions by means of a closed broken lines, highlighting the inside of suction box 30.

Preferably, the ventilation device is a fan 31 of the known type, which is adapted to suck air and water from the inlet pipe union 20. Advantageously, fan 31 is waterproof and insensitive to water flows.

More in detail, siphon 32 has a first end, or upstream end, which is connected to fan 31, and a second end, or downstream end, which is connected to outlet pipe union 40.

In particular, fan 31 is supplied with an electric power that can come either from mains supply 34 (120-220-240 Vac, based on the country in which the system is installed) or from a direct-current and low-voltage power supply or from a battery. Clearly, in case the civil mains supply is used, it could be necessary to use a voltage reducer for the power supply of fan 31. As already mentioned above, fan 31 is also connected to—and functionally cooperates with—siphon 32.

When sanitary apparatus 1 is not being used, fan 31 is disabled, it does not rotate and, therefore, the air is not sucked from the inside of sanitary apparatus 1. Inside siphon 32 there is a quantity of water 33 that came from tank 6 during the last flushing performed. The further siphon 32' has a further quantity of water as well, which is due to the water that has not been completely drained and tends to become stagnant in supply pipe 5.

In this way possible bad smells are prevented from flowing back into outlet pipe 40 from the sewerage system and from reaching sanitary apparatus 1, since water quantities 33 and 33' act as blocks against them.

Preferably, when a user of sanitary apparatus 1 is about to use it, for example by sitting on it or by approaching it, a presence sensor 35 is activated. In the embodiment shown, presence sensor 35 is electrically connected to fan 31 by means of a cable 34*b* and, in one of its simplest configurations, it acts as a switch on power supply 34, thus activating fan 31 that starts sucking air, hence pushing water 33 away from siphon 32.

Preferably, the presence sensor, which is schematically shown in FIG. 2 as a switch arranged under a support seat 1' of sanitary apparatus 1, can be—by way of non-limiting example—a pressure sensor arranged under a seat of the sanitary apparatus or an infrared sensor. In the latter case, the sensor can also be arranged in a remote position with respect to sanitary apparatus 1, provided that it aims at the area above the sanitary apparatus itself.

In this way, for the entire duration of the use of sanitary apparatus 1, possible bad smells are directly drawn and sucked from the place in which they are generated and follow a path that, starting from sanitary apparatus 1, extends through inlet union pipe 20, fan 31 and siphon 32 in order to reach outlet union pipe 40.

Bad smells cannot flow back into sewage outlet pipe 4 due to the presence of siphon 32 of sanitary apparatus 1 and, therefore, are necessarily kept downstream of the latter.

At the same time, said bad smells cannot be sucked into another place, because water supply pipe 5 is closed.

When the user stands up or leaves sanitary apparatus 1, presence sensor 35 is disabled, thus stopping the operation of fan 31.

Then, when lever 7 is activated, plug 8 is lifted from the lower edge of tank 6; the water contained therein falls along water supply pipe 5 and partially flows through inlet pipe union 20 and through fan 31, thus cleaning siphon 32, in order to then be drained in sewage outlet pipe 4 after having flown through outlet pipe union 40. Hence, the filter formed by water 33 inside siphon 32 is restored every time the flush of sanitary apparatus 1 is activated.

The further siphon 32' is cleaned in a similar manner, thus restoring the filter formed by the further water quantity 33'.

Figure 3:
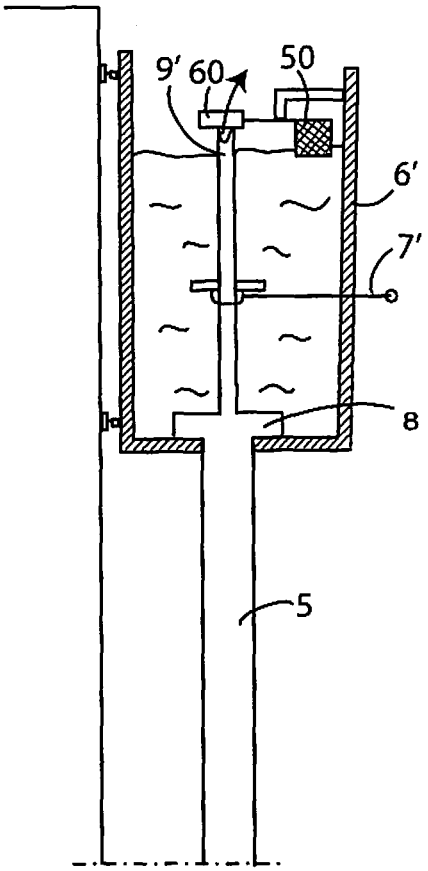
FIG. 3 shows a further enlarged view of a flushing water storage tank of the sanitary apparatus shown in FIG. 1.

FIG. 3 shows, in particular, an alternative embodiment of the tank indicated with number 6'. Said tank 6' is optionally provided with an overflow draining pipe 9', which allows excess water to flow out in case of a fault or an obstruction of the traditional water level limitation float available in the majority of tanks 6 of the known type.

With reference to FIG. 3, overflow draining pipe 9' is arranged coaxial to plug 8 and is fixed thereto so as to be lifted together with it when lever 7 is activated.

In order to guarantee the best possible operation of the system according to the present invention, it is necessary for the overflow draining pipe 9' to be able to be closed during the entire time in which sensor 35 is enabled, so as to make sure that the air and bad smell suction does not reach water supply pipe 5, but only sanitary apparatus 1.

In this case, a further preferred embodiment of the system according to the present invention comprises, furthermore, a second float 50, which is arranged inside tank 6' so that:

in the normal filling conditions of tank 6', the second float 50 acts on a plug 60 so as to close the draining pipe 9'; and in the excess filling conditions of tank 6', the second float allows plug 60 to open so as to allow the excess water to be drained, thus avoiding the overflow of tank 6'.

This result can be obtained, for example, by using a plug made of a floating material and by mounting the second float 50 and plug 60 on a horizontally pivoted mechanism.

The advantages of the system for the elimination of smells for flushing sanitary apparatus according to the present innovation are clear in the light of the description above. In particular, it allows users to easily eliminate bad smells by directly sucking the air inside the sanitary apparatus, thus avoiding or anyway minimizing their dispersion inside the bathroom.

Furthermore, the system according to the present innovation allows the air sucked from the sanitary apparatus to be directly conveyed into the sewerage system and, therefore, does require neither significant masonry works for the connection, for example, to a flue or to a similar pipe for the discharge of vapors and air nor projections towards the outside of the building, thus being able to be installed in buildings with a particular historical value.

Moreover, the device according to the present innovation allows air to be exclusively sucked from sanitary apparatus 1, even if water storage tank 6 is provided with an overflow draining pipe, which, in this case, is duly closed.

In addition, the typical smells of the sewerage system cannot flow through the system according to the present innovation, because since siphon 32, together with sanitary apparatus 1, prevents them from flowing back.

Furthermore, the system according to the present invention allows supply pipe 5 to be cleared from stagnant water, thus preventing said water from coming in the way between fan 31 and sanitary apparatus 1 and from causing an incorrect suction of bad smalls or an undesired bubbling during the operation.

Obviously, the system described above can be subject to variations and changes, without in this way going beyond the scope of protection of the present invention.

For example, according to an alternative of the present invention, the relative position of siphon and of the fan can be switched with respect to what described above.

It is also obvious that, even if in the of embodiment described herein sanitary apparatus 1 is supplied by a tank 6, said tank can be replaced by a water supply pipe under pressure, which, for example, can be opened and closed by means of a cock; in this case, the first embodiment of the system described herein would be applied without significant changes.

Naturally, the principle of the present invention being set forth, the embodiments and the implementation details can be widely changed with respect to what described above and shown in the drawings as a mere way of non-limiting example, without in this way going beyond the scope of protection provided by the accompanying claims.

The invention claimed is:

1. System for elimination of odors for a flushing sanitary apparatus; said sanitary apparatus being connected, at the inlet, to a flush water supply device by a supply pipe and being connected, at the outlet, to a sewage outlet pipe by a draining pipe fitting provided with a siphon; said system comprising:

at least one water and/or air inlet pipe union, which can be connected to said supply pipe;

at least one outlet pipe union, which can be connected to said sewage outlet pipe downstream of said draining pipe union;

a suction box, to which said at least one inlet pipe union leads and from which said outlet pipe union starts; said suction box comprising:

a motorized ventilation device supplying air from said inlet pipe union to said outlet pipe union, and a first siphon, adapted to be at least partially filled with water coming from said water supply device through said supply pipe after said sanitary has been flushed;

said ventilation device and said first siphon being arranged in said suction box mutually in series and being connected between said at least one inlet pipe union and said at least one outlet pipe union;

wherein said suction box comprises a second siphon, which can be connected between said supply pipe and said sewage outlet pipe and is arranged in parallel with respect to said first siphon and said ventilation device; said second siphon being adapted to be at least partially-filled with water in said supply pipe upstream of said sanitary.

2. The system according to claim 1, wherein said second siphon can be connected to said supply pipe downstream of said at least one inlet pipe union.

3. The system according to claim 1, wherein said suction box comprises a second water and/or air inlet pipe union, which can be connected to said supply pipe and leads to said second siphon.

4. The system according to claim 1, wherein said second siphon leads to said at least one outlet pipe union.

5. The system according to claim 1, wherein said suction box comprises a second outlet pipe union, which can be connected to said sewage outlet pipe downstream of said draining pipe union; said second siphon leading to said second outlet pipe union.

* * * * *